US006006935A

United States Patent [19]

Driver

[11] Patent Number: 6,006,935

[45] Date of Patent: Dec. 28, 1999

[54] DETACHABLE MULTI-CONTAINER FUEL TANK

[76] Inventor: Peter Driver, 1 Westridge Cottage, Colly Lane, Reigate, Surry, United Kingdom, RH2 9JN

[21] Appl. No.: 09/018,997

[22] Filed: Feb. 5, 1998

[51] Int. Cl.[6] ..... A47G 19/00; B65D 2/102

[52] U.S. Cl. ..... 220/23.4; 220/564; 222/143; 222/465.1

[58] Field of Search ..... 220/23.4, 564; 222/143, 465.1, 530

[56] References Cited

U.S. PATENT DOCUMENTS 3,194,426 7/1965 Brown, Jr. ..... 220/23.4
3,369,658 2/1968 Hasselmann ..... 220/23.4 X
4,125,207 11/1978 Ernst et al. ..... 220/23.4 X
5,749,485 5/1998 Chiu ..... 220/564

FOREIGN PATENT DOCUMENTS 790060 11/1935 France ..... 220/23.4

*Primary Examiner*—Allan N. Shoap
*Assistant Examiner*—Joe Merek

[57] ABSTRACT

A multi-compartment gas container is provided including a gas container having a first coupling mechanism formed thereon. A gas nozzle assembly is mounted on the gas container for facilitating the dispensing of gas therefrom. Further, at least one auxiliary container with a second coupling mechanism formed thereon is included for releasably coupling with the gas container.

2 Claims, 2 Drawing Sheets

DETACHABLE MULTI-CONTAINER FUEL TANK

BACKGROUND OF THE INVENTION

1. Field of the Invention

The present invention relates to connectable containers and more particularly pertains to a new detachable multi-container fuel tank for conveniently containing a plurality of vehicle related liquids and materials on a fuel tank.

2. Description of the Prior Art

The use of connectable containers is known in the prior art. More specifically, connectable containers heretofore devised and utilized are known to consist basically of familiar, expected and obvious structural configurations, notwithstanding the myriad of designs encompassed by the crowded prior art which have been developed for the fulfillment of countless objectives and requirements.

Known prior art connectable containers include U.S. Pat. No. 5,381,916; U.S. Pat. No. 4,889,254; U.S. Pat. Des. 333,177; U.S. Pat. No. 4,067,475; U.S. Pat. No. 4,133,445; and U.S. Pat. No. 5,447,249.

In these respects, the detachable multi-container fuel tank according to the present invention substantially departs from the conventional concepts and designs of the prior art, and in so doing provides an apparatus primarily developed for the purpose of conveniently containing a plurality of vehicle related liquids and materials on a fuel tank.

SUMMARY OF THE INVENTION

In view of the foregoing disadvantages inherent in the known types of connectable containers now present in the prior art, the present invention provides a new detachable multi-container fuel tank construction wherein the same can be utilized for conveniently containing a plurality of vehicle related liquids and materials on a fuel tank.

The general purpose of the present invention, which will be described subsequently in greater detail, is to provide a new detachable multi-container fuel tank apparatus and method which has many of the advantages of the connectable containers mentioned heretofore and many novel features that result in a new detachable multi-container fuel tank which is not anticipated, rendered obvious, suggested, or even implied by any of the prior art connectable containers, either alone or in any combination thereof.

To attain this, the present invention generally comprises a central gas container. The gas container has a planar rectangular top face, a planar rectangular bottom face, a pair of short side faces and a pair of elongated side faces thus defining an interior space. The top face has a handle mounted to a central extent thereof. As shown in FIG. 3, the handle includes a horizontal top bar supported by a pair of angled stanchions. Situated along a line defined by the stanchions is a threaded outlet. The threaded outlet is situated between the handle and one of the side faces. A lid is removably coupled to the threaded outlet for allowing selective access to the interior space. As shown in FIGS. 1 & 2, both of the elongated side faces and one of the short side faces have a plurality of vertically oriented cylindrical recesses formed thereon between the top face and a point just short of the bottom face. Also included is a gas nozzle assembly having an elongated bellowed tube with an end removably coupled to the threaded outlet for dispensing gas from the gas container. The gas nozzle assembly has a mounting subassembly including an inverted L-shaped clip mounted on one of the stanchions of the handle. Associated therewith is a vertical clamp coupled to the top face of the gas container. During use, the clip and clamp are adapted to removably secure the tube to the gas container for storage purposes. Next provided is four auxiliary liquid containers each having a top face, a bottom face, and a plurality of side faces formed therebetween to define an interior space half that of the gas container. Each auxiliary container has a threaded outlet. A lid is removably coupled to the threaded outlet for allowing access to the interior space. At least one vertically oriented cylindrical recess is formed on one of the side faces between the top face and a point just short of the bottom face. Also, at least one vertically oriented cylindrical protrusion is formed on another one of the side faces between the top face and the bottom face. By this structure, the liquid containers are each interconnectable to each other and further along one of the elongated side faces of the gas container. Finally, a dry container includes a bottom face and a periphery formed thereon for defining an interior space and an open top. The interior space has a volume approximately equal to that of the gas container. The periphery is defined by a pair of elongated side faces and a pair of short side faces. One of the elongated side faces has an upper edge with a planar lid pivotally coupled thereto between an open and closed orientation. The side face to which the lid is coupled has a pair of vertically oriented cylindrical protrusions formed on a central extent thereof and between the open top and the bottom face. Note FIG. 1. Formed on ends of the aforementioned side face of the dry container is a pair of vertically oriented cylindrical recesses. Such recesses are situate between the open top and a point just short of the bottom face.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new detachable multi-container fuel tank apparatus and method which has many of the advantages of the connectable containers mentioned heretofore and many novel features that result in a new detachable multi-container fuel tank which is not anticipated, rendered obvious, suggested, or even implied by any of the prior art connectable containers, either alone or in any combination thereof.

It is another object of the present invention to provide a new detachable multi-container fuel tank which may be easily and efficiently manufactured and marketed.

It is a further object of the present invention to provide a new detachable multi-container fuel tank which is of a durable and reliable construction.

An even further object of the present invention is to provide a new detachable multi-container fuel tank which is susceptible of a low cost of manufacture with regard to both materials and labor, and which accordingly is then susceptible of low prices of sale to the consuming public, thereby making such detachable multi-container fuel tank economically available to the buying public.

Still yet another object of the present invention is to provide a new detachable multi-container fuel tank which provides in the apparatuses and methods of the prior art some of the advantages thereof, while simultaneously overcoming some of the disadvantages normally associated therewith.

Still another object of the present invention is to provide a new detachable multi-container fuel tank for conveniently containing a plurality of vehicle related liquids and materials on a fuel tank.

Even still another object of the present invention is to provide a new detachable multi-container fuel tank that includes a gas container having a first coupling mechanism formed thereon. A gas nozzle assembly is mounted on the gas container for facilitating the dispensing of gas therefrom. Further, at least one auxiliary container with a second coupling mechanism formed thereon is included for releasably coupling with the gas container.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
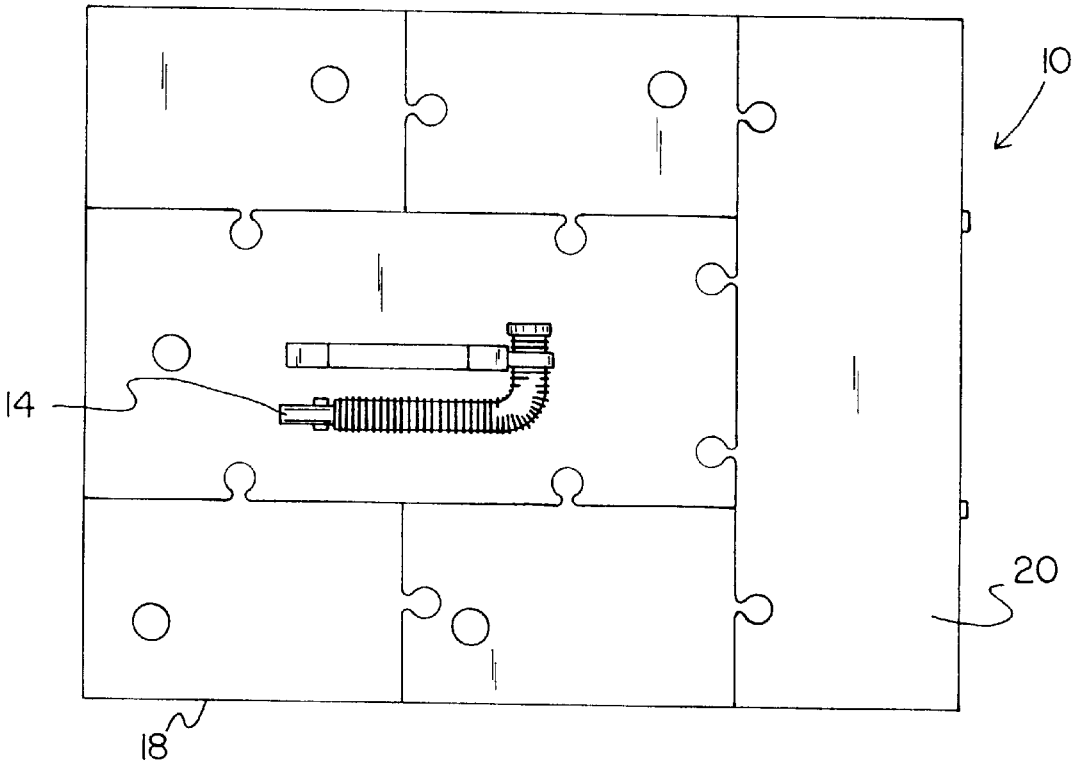
FIG. 1 is a top view of a new detachable multi-container fuel tank according to the present invention.

With reference now to the drawings, and in particular to FIGS. 1 through 4 thereof, a new detachable multi-container fuel tank embodying the principles and concepts of the present invention and generally designated by the reference numeral 10 will be described.

Figure 2:
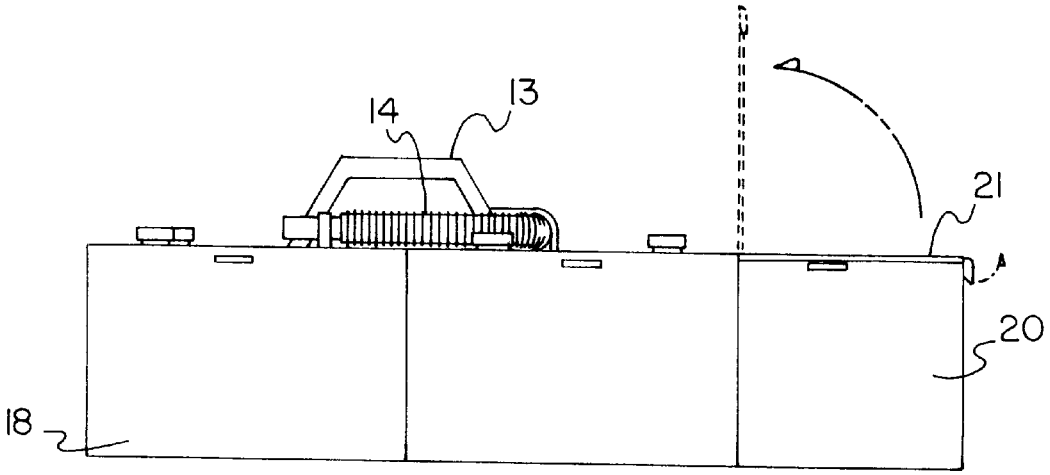
FIG. 2 is a side view of the present invention.
Figure 3:
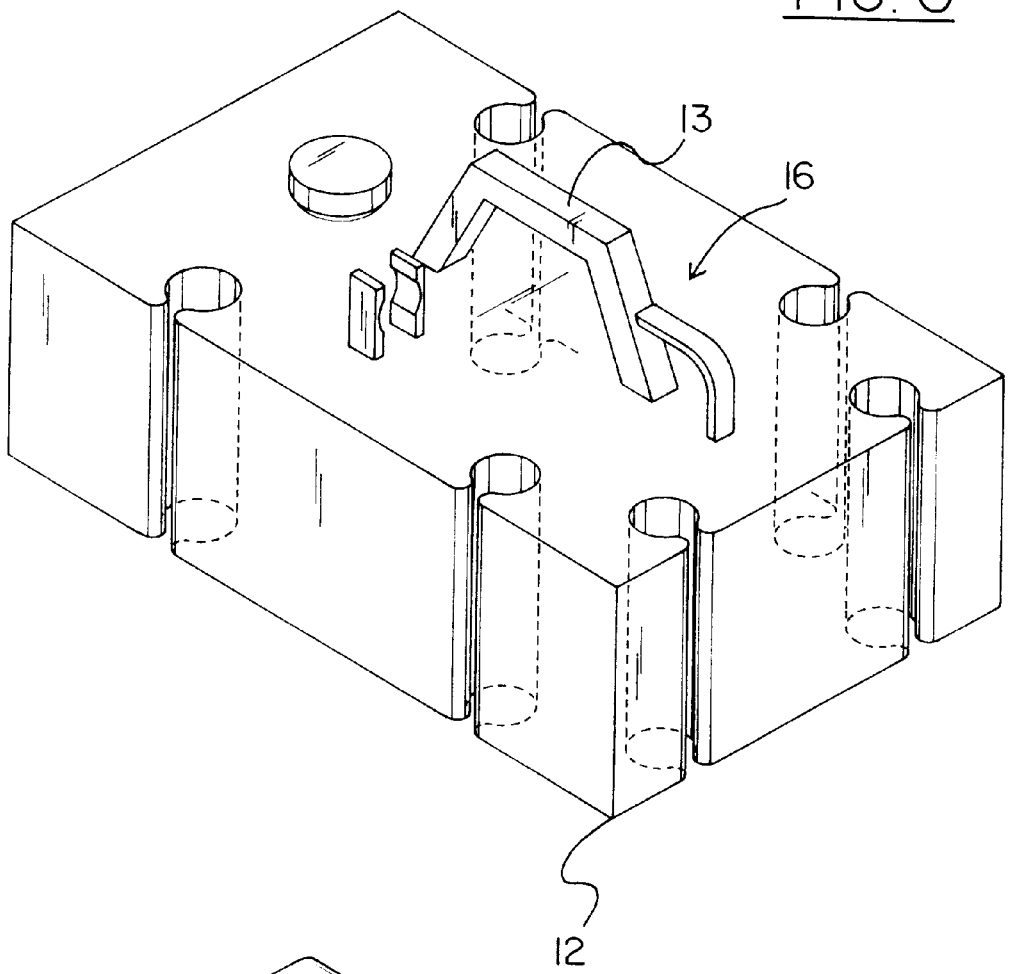
FIG. 3 is a perspective view of the gas container of the present invention.

The present invention, designated as numeral 10, includes a plastic central gas container 12. The gas container has a planar rectangular top face, a planar rectangular bottom face, a pair of short side faces and a pair of elongated side faces thus defining an interior space. The top face has a handle 13 mounted to a central extent thereof. As shown in FIG. 3, the handle includes a horizontal top bar supported by a pair of angled stanchions. Situated along a line defined by the stanchions is a threaded outlet. The threaded outlet is situated between the handle and one of the side faces. A lid is removably coupled to the threaded outlet for allowing selective access to the interior space. As shown in FIGS. 1 & 2, both of the elongated side faces and one of the short side faces have a plurality of vertically oriented cylindrical recesses formed thereon between the top face and a point just short of the bottom face. In the preferred embodiment, a pair of recesses are formed on each of the proper side faces.

Also included is a gas nozzle assembly 14 having an elongated bellowed tube with an end removably coupled to the threaded outlet for dispensing gas from the gas container. The gas nozzle assembly has a mounting subassembly 16 including an inverted L-shaped clip mounted on one of the stanchions of the handle. Associated therewith is a resilient vertical clamp coupled to the top face of the gas container. During use, the clip and clamp are adapted to removably secure the tube to the gas container for storage purposes.

Next provided is four auxiliary liquid containers 18 each having a top face, a bottom face, and a plurality of side faces formed therebetween to define an interior space half that of the gas container. Each auxiliary container has a threaded outlet. A lid is removably coupled to the threaded outlet for allowing access to the interior space. At least one vertically oriented cylindrical recess is formed on one of the side faces between the top face and a point just short of the bottom face. Also, at least one vertically oriented cylindrical protrusion is formed on another one of the side faces between the top face and the bottom face. By this structure, the liquid containers are each interconnectable to each other and further along one of the elongated side faces of the gas container. In the preferred embodiment, the auxiliary liquid containers contain windscreen cleaner, water, car shampoo, oil and the like.

Finally, a dry container 20 includes a bottom face and a periphery formed thereon for defining an interior space and an open top. The interior space has a volume approximately equal to that of the gas container. The periphery is defined by a pair of elongated side faces and a pair of short side faces. One of the elongated side faces has an upper edge with a planar lid 21 pivotally coupled thereto and capable of pivoting between an open and closed orientation. Preferably, the lid has a locking mechanism associated therewith for selectively locking the lid in the closed orientation.

The side face to which the lid is coupled has a pair of vertically oriented cylindrical protrusions formed on a central extent thereof and between the open top and the bottom face. Note FIG. 1. Formed on ends of the aforementioned side face of the dry container is a pair of vertically oriented cylindrical recesses. Such recesses are situate between the open top and a point just short of the bottom face. The dry container is specifically tailored for containing, tissue, cloth and the like.

During use, the dry container is releasably coupled to the side faces of two of the auxiliary liquid containers and the gas container opposite the threaded outlet thereof. As such, the top faces and bottom faces of the containers remain in coplanar relationship, respectively.

Figure 4:
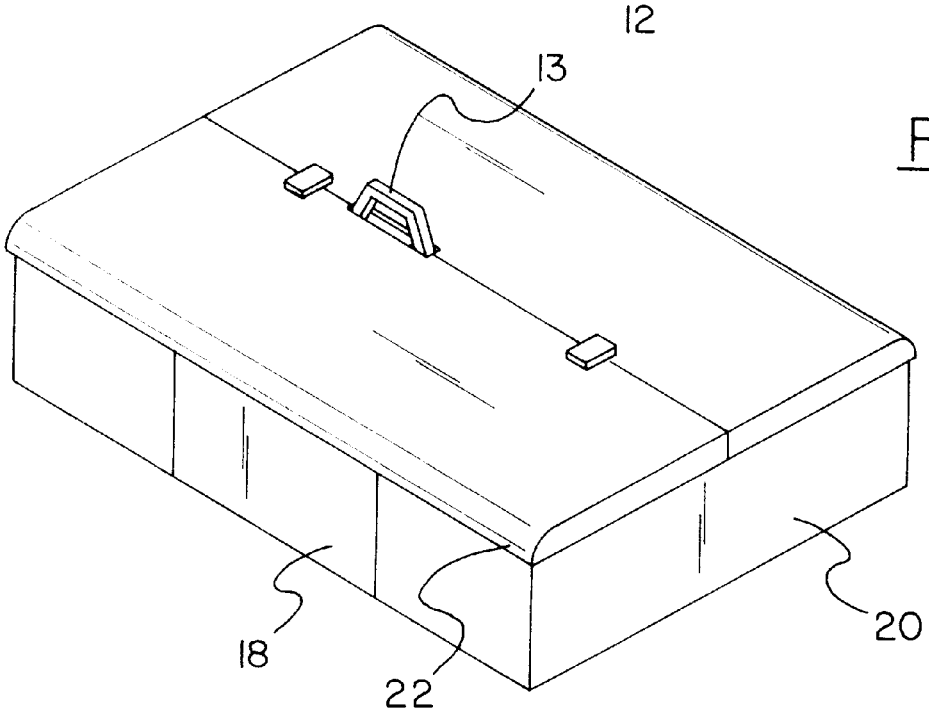
FIG. 4 is a perspective view of the present invention with the optional cover.

It should be noted that each of the cylindrical recesses and protrusions each having a bulb portion and a thin strip portion. As an option, a cover 22 may be snappily mounted on the top faces of the containers when interconnected, as shown in FIG. 4.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A multi-compartment gas container comprising, in combination:

a central gas container including a planar rectangular top face, a planar rectangular bottom face, a pair of short side faces and a pair of elongated side faces thus defining an interior space, the top face having a handle mounted to a central extent thereof and including a horizontal top bar supported by a pair of angled stanchions, a threaded outlet situated along a line defined by the stanchions and between the handle and one of the side faces and a lid removably coupled to the threaded outlet for allowing selective access to the interior space, both of the elongated side faces and one of the short side faces having a plurality of vertically oriented cylindrical recesses formed thereon between the top face and a point just short of the bottom face;

a gas nozzle assembly including an elongated bellowed tube with an end removably coupled to the threaded outlet for dispensing gas from the gas container, the gas nozzle assembly having a mounting subassembly including an inverted L-shaped clip mounted on one of the stanchions of the handle and a vertical clamp mounted to the top face of the gas container, the clip and clamp adapted to removably secure the tube to the gas container for storage purposes;

four auxiliary liquid containers each having a top face, a bottom face, and a plurality of side faces formed therebetween to define an interior space half that of the gas container, each auxiliary container having a threaded outlet and a lid removably coupled to the threaded outlet for allowing access to the interior space, at least one vertically oriented cylindrical recess formed on one of the side faces between the top face and a point just short of the bottom face and at least one vertically oriented cylindrical protrusion formed on another one of the side faces between the top face and the bottom face, whereby the liquid containers are each interconnectable to each other and further along one of the elongated side faces of the gas container; and a dry container including a bottom face and a periphery formed thereon for defining an interior space and an open top with the interior space having a volume approximately equal to that of the gas container, the periphery defined by a pair of elongated side faces and a pair of short side faces, one of the elongated side faces having an upper edge with a planar lid pivotally coupled thereto between an open and closed orientation, the side face to which the lid is coupled having a pair of vertically oriented cylindrical protrusions formed on a central extent thereof and between the open top and the bottom face and a pair of vertically oriented cylindrical recesses formed on ends of the dry container between the open top and a point just short of the bottom face, whereby the dry container is releasably coupled to the side faces of two of the auxiliary liquid containers and the gas container opposite the threaded outlet thereof such that the top faces and bottom faces of the containers remain in coplanar relationship, respectively.

2. A multi-compartment gas container comprising:

a central gas container including a top face, a bottom face, a pair of short side faces and a pair of elongated side faces thus defining an interior space, the top face having a handle mounted thereto and including a horizontal top bar supported by a pair of stanchions, a threaded outlet situated along a line defined by the stanchions and between the handle and one of the side faces and a lid removably coupled to the threaded outlet for allowing selective access to the interior space, both of the elongated side faces and one of the short side faces having a plurality of recesses formed thereon between the top face and the bottom face;

a gas nozzle assembly including an elongated bellowed tube with an end coupled to the threaded outlet for dispensing gas from the gas container, the gas nozzle assembly having a mounting subassembly including an inverted L-shaped clip mounted on one of the stanchions of the handle and a clamp mounted to the top face of the gas container, the clip and clamp adapted to removably secure the tube to the gas container for storage purposes;

a plurality of auxiliary liquid containers each having a top face, a bottom face, and a plurality of side faces formed therebetween to define an interior space half that of the gas container, each auxiliary container having a threaded outlet and a lid removably coupled to the threaded outlet for allowing access to the interior space, at least one vertically oriented recess formed on one of the side faces between the top face and a point just short of the bottom face and at least one vertically oriented protrusion formed on another one of the side faces between the top face and the bottom face, whereby the liquid containers are each interconnectable to each other and further along one of the elongated side faces of the gas container; and a dry container including a bottom face and a periphery formed thereon for defining an interior space and an open top with the interior space having a volume approximately equal to that of the gas container, the periphery defined by a pair of elongated side faces and a pair of short side faces, one of the elongated side faces having an upper edge with a planar lid pivotally coupled thereto between an open and closed orientation, the side face to which the lid is coupled having a pair of vertically oriented protrusions formed on a central extent thereof and between the open top and the bottom face and a pair of vertically oriented recesses formed on ends of the dry container between the open top and the bottom face, whereby the dry container is releasably coupled to the side faces of two of the auxiliary liquid containers and the gas container opposite the threaded outlet thereof such that the top faces and bottom faces of the containers remain in coplanar relationship, respectively.

* * * * *